US008556407B2

(12) United States Patent
Toya et al.

(10) Patent No.: US 8,556,407 B2
(45) Date of Patent: Oct. 15, 2013

(54) RECORDING APPARATUS WITH EXTENDED FIXING UNIT

(75) Inventors: Akihiro Toya, Suwa (JP); Seigo Mizutani, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 208 days.

(21) Appl. No.: 12/868,901

(22) Filed: Aug. 26, 2010

(65) Prior Publication Data

US 2011/0050824 A1 Mar. 3, 2011

(30) Foreign Application Priority Data

Aug. 27, 2009 (JP) ..... 2009-196445
Mar. 23, 2010 (JP) ..... 2010-066019

(51) Int. Cl.
*B41J 2/01* (2006.01)

(52) U.S. Cl.
USPC ..... 347/102

(58) Field of Classification Search
None
See application file for complete search history.

(56) References Cited

U.S. PATENT DOCUMENTS 5,510,822 A 4/1996 Vincent et al.
7,182,454 B2 2/2007 Nakazawa
2006/0001721 A1 1/2006 Yraceburu et al.
2007/0172285 A1* 7/2007 Izawa et al. ..... 400/188
2008/0158324 A1* 7/2008 Yraceburu et al. ..... 347/102
2010/0033545 A1* 2/2010 Caiger et al. ..... 347/102

FOREIGN PATENT DOCUMENTS

EP 1 442 892 A1 8/2004
EP 1442892 8/2004
JP 63-035345 2/1988
JP 2003-127531 5/2003
JP 2004-230709 8/2004
JP 2005-329605 12/2005
JP 2009-073012 4/2009
JP 2009073012 A * 4/2009

OTHER PUBLICATIONS

European Search Report dated Dec. 18, 2012 for European Patent Application No. 12184123.3.

* cited by examiner

*Primary Examiner* — Geoffrey Mruk
*Assistant Examiner* — Bradley Thies
(74) *Attorney, Agent, or Firm* — Workman Nydegger

(57) ABSTRACT

There is provided a recording apparatus. The recording apparatus includes: a support member which supports a recording medium; a recording head which applies a recording material to one surface of the recording medium supported on the support member; and a fixing unit which fixes the recording material adhered to the one surface of the recording medium transported from the support member, wherein the support member and the fixing unit are arranged to be partly overlapped with each other in an up and down direction.

5 Claims, 7 Drawing Sheets

RECORDING APPARATUS WITH EXTENDED FIXING UNIT

Japanese Patent Application No. 2009-196445, filed Aug. 27, 2009 and 2010-066019 filed Mar. 23, 2010 are incorporated by reference in their entirety herein.

BACKGROUND

1. Technical Field

The present invention relates to a recording apparatus such as an ink jet printer, and more particularly, to a recording apparatus of a lateral scan type in which a recording head moves in a transport direction of a recording medium to perform recording.

2. Related Art

In the related art, there is well known an ink jet printer (hereinafter, referred to as a "printer") as a kind of a recording apparatus in which a recording material is adhered to a target to perform recording. Recently, there has been proposed a technology in which a liquid (recording material) is ejected to a continuous recording medium (target) using such a printer to continuously print a plurality of unit images which will be used as labels by being cut later. (For example, refer to JP-A-2009-73012)

That is, in the printer as disclosed in JP-A-2009-73012, a platen is installed in a midstream position of a transport path of a continuous recording medium, and ink (recording material) is ejected onto the continuous recording medium in the state of being stopped on the platen to perform recording. Then, an ink printed image formed on the continuous recording medium is heated and forcibly dried in a forcible drying region which is a recording material fixing region installed in the vicinity of a downstream side in the transport path of the continuous recording medium with reference to the platen. Thereafter, the continuous recording medium of which the ink printed image is forcibly dried by the forcible drying region is rolled by a roll driving shaft installed on a further downstream side with reference to the forcible drying region in the transport path of the continuous recording medium.

However, in the printer as disclosed in JP-A-2009-73012, since the platen and the forcible drying region are respectively installed to occupy an independent installation space in a horizontal direction, there is a problem that the entire apparatus becomes large-sized in the horizontal direction.

Further, in the lateral scan type printer in which the recording head moves in the transport direction of the recording medium to perform recording, if it is assumed that the length of a recording region in the transport direction of the recording medium, which is secured on the platen, is represented as L, the recording medium is transported by the length L with a single transport operation. That is, the transport operation of the transport amount L and a lateral scanning (recording performance operation) by means of the recording head are alternately performed.

In this respect, when a recording surface after completion of recording enters into the forcible drying region after completion of recording, if the length of the forcible drying region is not appropriately set, at least part of the recording surface after completion of recording simply passes through the forcible drying region without being stopped, by means of the transport operation of the transport amount L. That is, the time for which the recording surface after completion of recording stays in the forcible drying region is not secured, and thus, the drying may not be sufficiently performed.

SUMMARY

An advantage of some aspects of the invention is that it provides a recording apparatus which can restrict the entire apparatus from being large-sized in a horizontal direction and can reliably perform fixing of a recording material in a recording material fixing section.

According to a first aspect of the present invention, there is provided a recording apparatus including: a support member which supports a recording medium; a recording head which applies a recording material to one surface of the recording medium supported on the support member; and a fixing unit which fixes the recording material adhered to the one surface of the recording medium transported from the support member, wherein the support member and the fixing unit are arranged to be partly overlapped with each other in an up and down direction.

With such a configuration, the support member and the fixing unit are arranged to be at least partly overlapped with each other from a planar view. Thus, these elements share an installation space in a horizontal direction, whereby the installation space for these elements can be reduced in size. As a result, the entire apparatus can be restricted from being large-sized in the horizontal direction.

According to a second aspect of the present invention, there is provided a recording apparatus including: a support member which supports a recording medium; a recording head which applies a recording material to one surface of the recording medium supported on the support member; and a fixing unit which fixes the recording material adhered to the one surface of the recording medium transported from the support member, wherein the recording head moves in a transport direction of the recording medium in a state where the recording medium is positioned on the support member to perform recording, wherein the length of a fixing region of the fixing unit in the transport direction of the recording medium is equal to or larger than the length of a recording region of the support member in the transport direction of the recording medium, and wherein the support member and the fixing unit are arranged to be overlapped with each other in an up and down direction.

With such a configuration, the support member and the fixing unit are arranged to be at least partly overlapped with each other from a planar view. Thus, these elements share an installation space in a horizontal direction, whereby the installation space for these elements can be reduced in size. As a result, the entire apparatus can be restricted from being large-sized in the horizontal direction.

Further, since the length of the fixing region of the fixing unit in the transport direction of the recording medium is equal to or larger than the length of the recording region of the support member in the transport direction of the recording medium, in the recording apparatus of a lateral scan type in which an intermittent transport operation is performed for the recording medium, a recording surface after completion of recording necessarily stays inside the fixing unit for a recording medium stop time in the intermittent transport at least one time. Accordingly, part of the recording surface after completion of recording can be prevented from simply passing through the fixing region without stop, and the time for which the recording surface stays inside the fixing unit can be secured. Thus, the recording surface can be sufficiently fixed.

According to a third aspect of the present invention, there is provided a recording apparatus according to the second aspect as described above, wherein a transport roller which transports the recording medium is installed within the same stage as the fixing unit and is provided on the outside of the fixing unit.

With such a configuration, as the transport roller which transports the recording medium and is installed in the same stage as the fixing unit and is provided on the outside of the fixing unit. In a case where the fixing unit is the type of applying heat to the recording medium to facilitate the fixing of the recording material, it is possible to prevent temperature irregularities inside the fixing unit and to prevent heat from escaping through the transport roller, thereby preventing reduction in the fixing efficiency.

According to a fourth aspect of the present invention, there is provided a recording apparatus according to the third aspect, further including a rolling unit which to rolls the recording medium after completion of recording, wherein a bending transport path of the recording medium, in which the recording medium is bent after being discharged from the fixing unit and is directed to the rolling unit, is arranged to be partly overlapped with the fixing unit under the fixing unit.

With such a configuration, as the bending transport path of the recording medium, in which the recording medium is bent after being discharged from the fixing unit and is directed to the rolling unit, is arranged to be overlapped with the fixing unit under the fixing unit, even though the recording apparatus is configured to further include the bending transport path, the entire recording apparatus can be restricted from being large-sized in the horizontal direction.

According to a fifth aspect of the present invention, there is provided a recording apparatus according to the fourth aspect, wherein an intermediate transport path including the fixing unit is installed under an upper transport path including the support member, and wherein the upper transport path, the intermediate transport path and the bending transport path are arranged to be partly overlapped with each other in a parallel manner.

With such a configuration, since the upper transport path, the intermediate transport path and the bending transport path are arranged to be partly overlapped with each other in a parallel manner, it is possible to restrict the height measurement of the recording apparatus to a minimum size.

In any one of the above described aspects, the recording apparatus may further include a medium guide which guides the recording medium so that the one surface thereof does not become a concave surface until the recording medium to which the recording material is adhered is discharged from the fixing unit and is configured to bend and guide the recording medium so that the one surface thereof becomes a concave surface after the recording medium is discharged from the fixing unit.

With such a configuration, at a point of time before the recording material adhered to the recording medium is fixed by the fixing unit, the transport direction of the recording medium is changed in a state where the support member does not contact the surface to which the recording material is adhered. Thus, the support member and the fixing unit are arranged to be overlapped with each other in the up and down direction, and thus, even in the case where the transport direction of the recording medium is changed toward the fixing unit, a recording image formed on the recording medium can be restricted from being jumbled on the support member.

In addition, in any one of the above described aspects, the recording medium may be formed with a plurality of stacked members, and the recording apparatus may further include a first transport direction changing means which is installed between the support member and the fixing unit in the transport path of the recording medium, and bends the transport path to change the transport direction of the recording medium; and a second transport direction changing means which is installed on a downstream side of the transport path with reference to the fixing unit, and bends the transport path to change the transport direction of the recording medium, wherein the curvature of a curved section of the transport path formed by the second transport direction changing means may be set to be smaller than the curvature of a curved section of the transport path formed by the first transport direction changing means.

In general, when the recording medium is heated in the process of passing through the fixing unit, an adhesive force of an adhesive which bonds the plurality of stacked members becomes weak. In this respect, according to the above configuration, since the transport direction of the recording medium is smoothly changed by the second transport direction changing means in a position on the downstream side of the transport path with reference to the fixing unit, it is possible to restrict the plurality of stacked members from being separated from each other.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
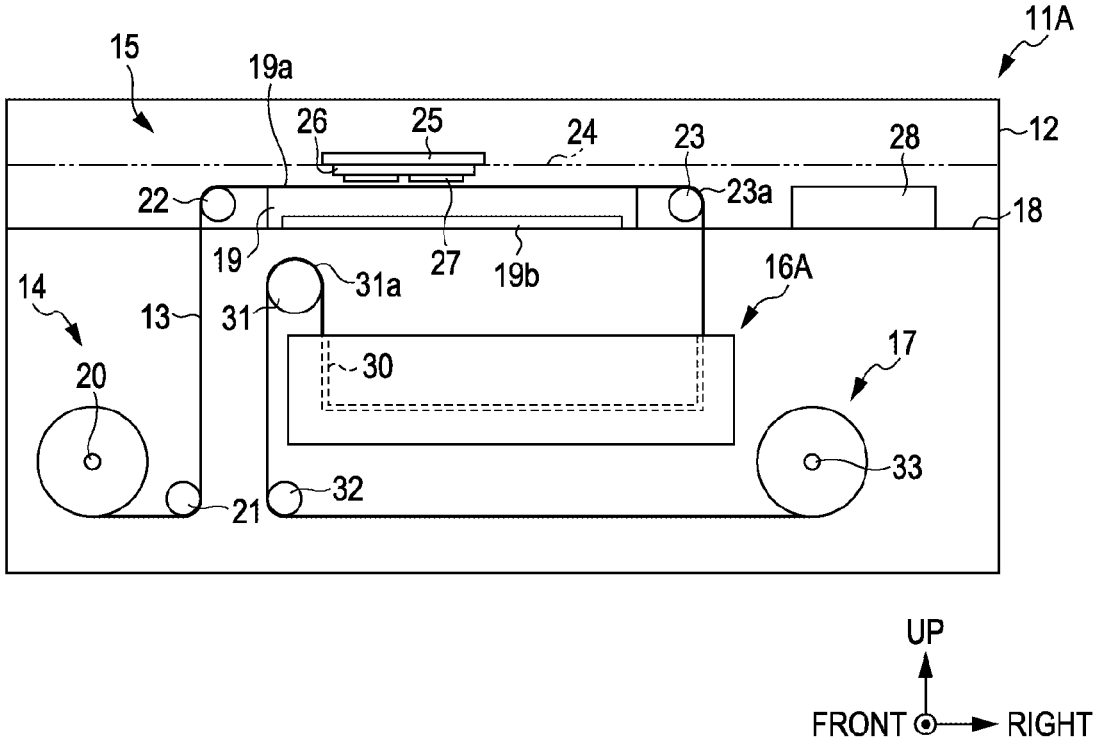
FIG. 1 is a diagram illustrating a schematic configuration of a recording apparatus according to a first embodiment of the present invention.
Figure 2:
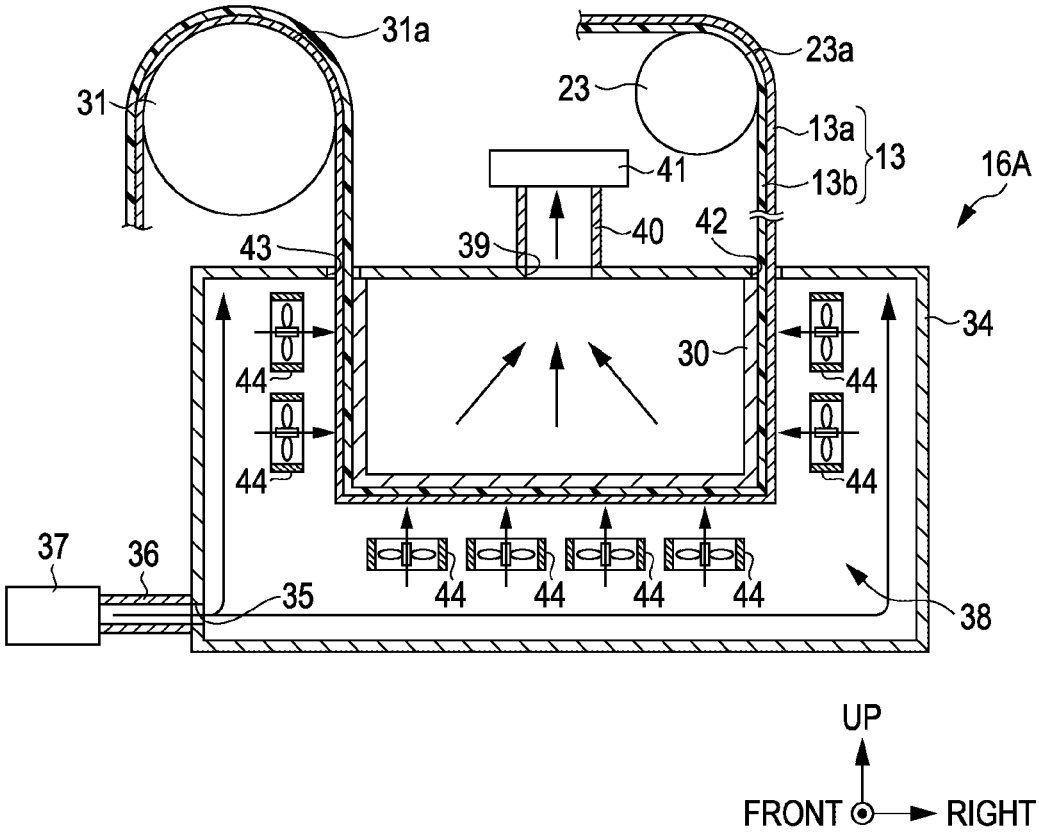
FIG. 2 is a sectional view illustrating a drying device according to a first embodiment of the present invention.
Figure 3:
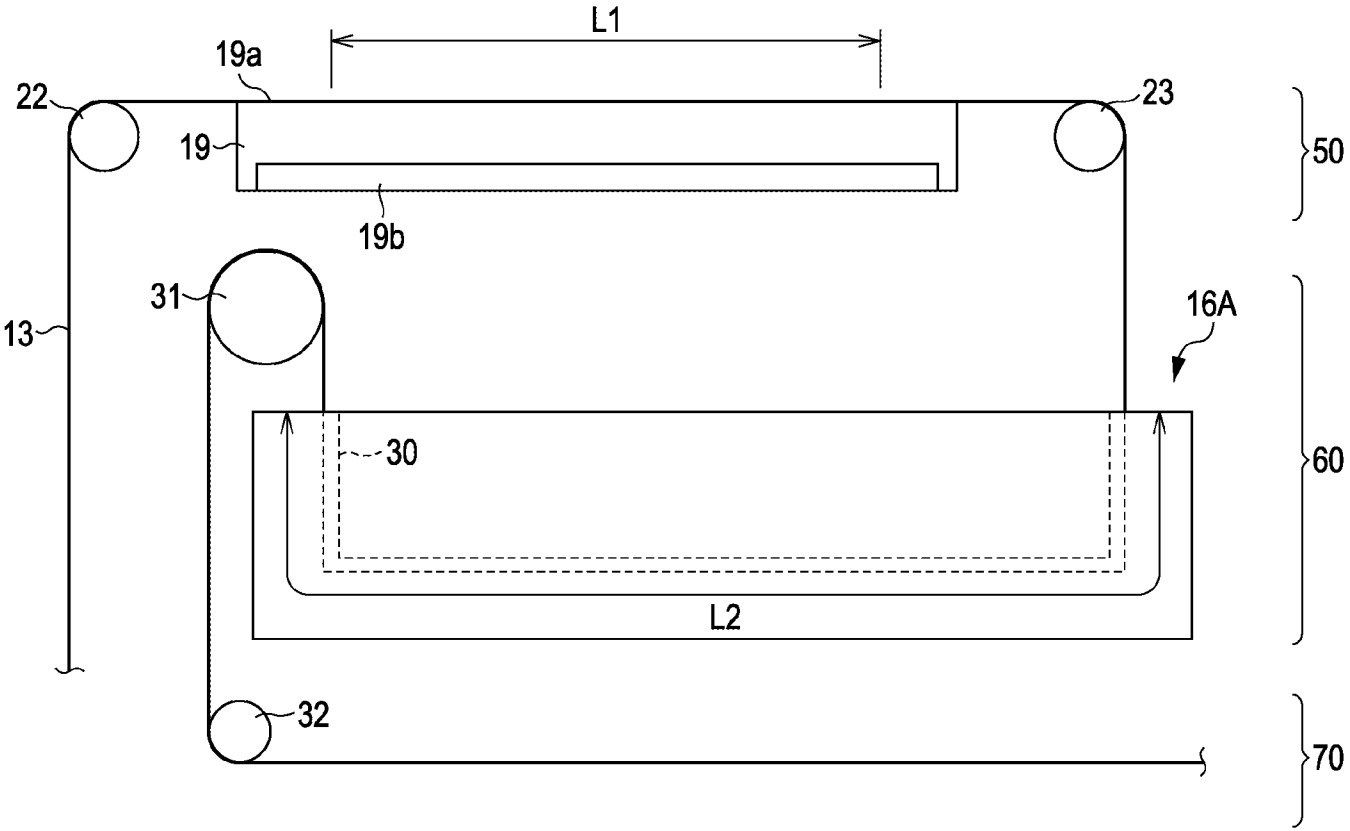
FIG. 3 is a partly enlarged view of FIG. 1.

Hereinafter, an ink jet printer (hereinafter, referred to as a "printer") according to a specific embodiment (a first embodiment) of the present invention will be described with reference to FIGS. 1 to 3. Here, FIG. 1 is a diagram illustrating a schematic configuration of a printer 11A according to the first embodiment of the present invention; FIG. 2 is a diagram illustrating a schematic configuration of a drying device 16A; and FIG. 3 is a partly enlarged view illustrating FIG. 1. In this description, the terms of a "front and rear direction", a "left and right direction" and an "up and down direction" are used to represent directions indicated by arrows in the respective figures.

As shown in FIG. 1, the printer 11A which is a recording apparatus includes a main body case 12 having a rectangular parallelepiped shape. In the main body case 12 are installed a supply section 14 which supplies a recording medium 13 having an elongated shape, a printing room 15 in which ink as a recording material is ejected onto the recording medium 13 to perform printing, the drying device 16A as a fixing unit which performs a drying process with respect to the recording medium 13 to which the ink is adhered by the printing, and a rolling section 17 which rolls the recording medium 13 which has undergone the drying process.

That is, a base 18 of a plate shape is installed in a position which is located slightly above a central section of the main body case 12 in the up and down direction so as to partition the inside of the main body case 12 in the up and down direction. A space above the base 18 serves as the printing room 15 in which a platen 19 as a support member of a rectangular plate shape is supported on the base 18. In a space under the base 18, the supply section 14 is installed in a left side position which is an upstream side in a transport direction of the recording medium 13, and the drying device 16A and the rolling section 17 are installed in a right side position which is a downstream side therein.

According to the present embodiment, as shown in FIG. 2, the recording medium 13 is formed by stacking a seal material 13*a* on which ink is ejected to perform printing in the printing room 15, and a base film 13*b* to which the seal material 13*a* is adhered in a detachable manner.

As shown in FIG. 1, a rolling shaft 20 extending in the front and rear direction is installed in the supply section 14 to be able to rotate, and the recording medium 13 is supported to be able to integrally rotate with the rolling shaft 20 in a state where the recording medium 13 is rolled in advance in a roll shape with respect to the rolling shaft 20. That is, as the rolling shaft 20 rotates, the recording medium 13 is supplied from the supply section 14 to be transported on a downstream side of the transport direction. Further, on the right side of the supply section 14, a first roller 21 which rolls up the recording medium 13 supplied from the rolling shaft 20 from a lower right side so as to change the transport direction of the recording medium 13 in a vertical up direction is provided to be extended in the front and rear direction in a state where the first roller 21 is in parallel with the rolling shaft 20.

On the other hand, in a position corresponding to the lower side first roller 21 in the up and down direction, on the left side of the platen 19 in the printing room 15, a second roller 22 is provided to be extended in the front and rear direction in a state where the second roller 22 is in parallel with the lower side first roller 21. Further, the recording medium 13 of which the transport direction changes in the vertical up direction by the first roller 21 is rolled-up from the lower left side in the second roller 22, and thus, the transport direction changes in the horizontal right direction to slide on an upper surface of the platen 19.

Further, on the right side of the platen 19 in the printing room 15, a third roller 23 which faces the right side second roller 22 in the left and right direction, with the platen 19 being interposed therebetween, is provided to be extended in the front and rear direction in a state where the third roller 23 is in parallel with the second roller 22. Further, each installation position of the second roller 22 and the third roller 23 is adjusted so that each top section thereof has the same height as an upper surface 19*a* of the platen 19 which supports the recording medium 13. Thus, the recording medium 13 of which the transport direction changes in the horizontal right direction by the second roller 22 located on the left side in the printing room 15 is transported on the right side which is a downstream side while being slid on the upper surface 19*a* of the platen 19. A platen heater 19*b* is installed in the platen 19, and is configured to heat the recording medium 13 supported on the upper support surface 19*a* of the platen 19.

Further, in the front and rear sides of the platen 19 in the printing room 15, a guide rail 24 (indicated by a double-dotted chain in FIG. 1) which is extended in the left and right direction is installed to make a pair. An upper surface of the guide rail 24 is higher than the upper surface 19*a* of the platen 19, and a rectangular carriage 25 is supported on upper surfaces of both the guide rails 24 in a state where the rectangular carriage 25 can reciprocatingly move in the left and right direction along the both guide rails 24, on the basis of driving of a driving mechanism (not shown). Further, a recording head 27 is supported through a support plate 26 on a lower surface side of the carriage 25.

Figure 5:
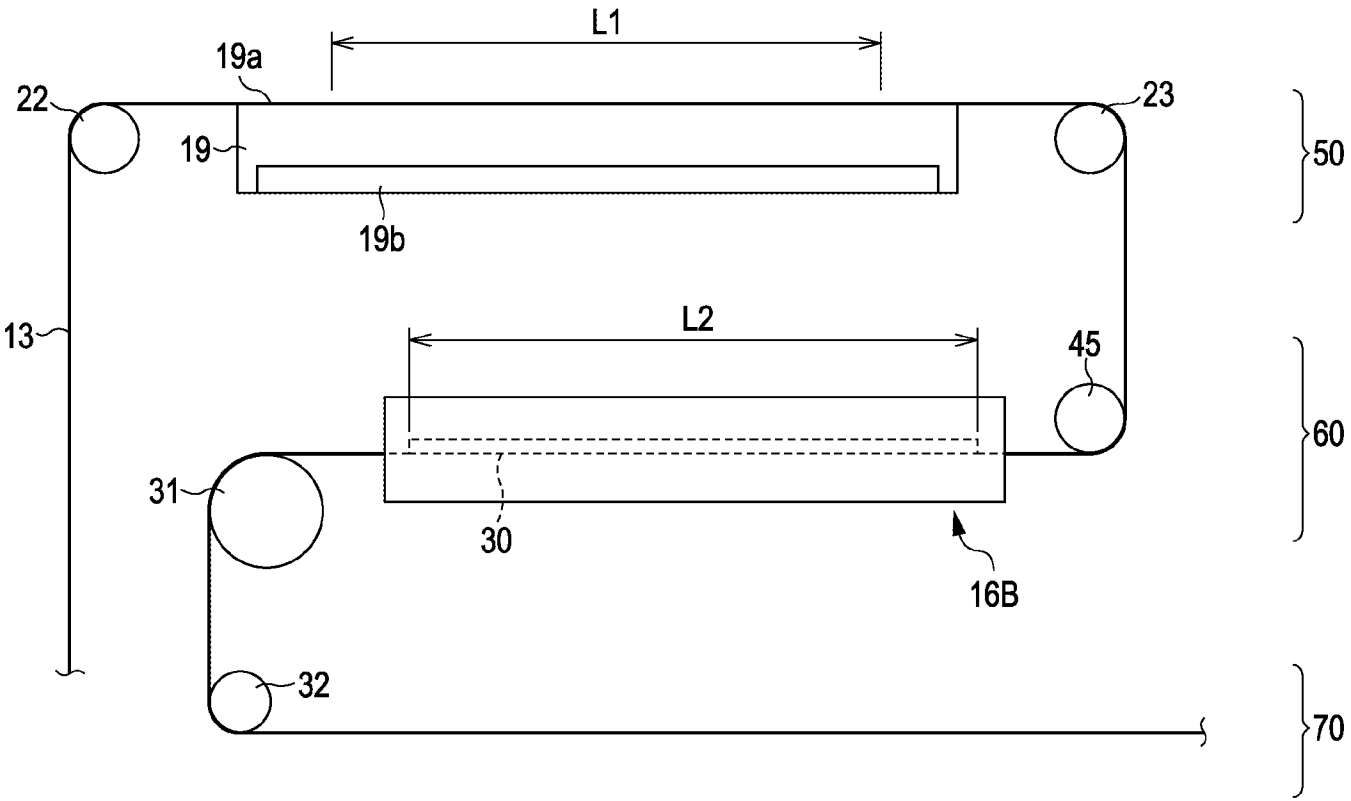
FIG. 5 is a partly enlarged view of FIG. 4A.

In the printing room 15, a predetermined range on the platen 19 becomes a printing region, and the recording medium 13 is configured to be intermittently transported in the unit of the printing region. A reference numeral L1 in FIG. 3 represents the length of a printing region in the transport direction of the recording medium (which is the case with another embodiment illustrated in FIG. 5). Further, as ink is ejected from the recording head 27 in accordance with the reciprocating movement of the carriage 25 with respect to the recording medium 13 in the state of being stopped on the platen 19 by the intermittent transport in the unit of the printing region (lateral scan), the printing with respect to the recording medium 13 is performed. Further, in the printing room 15, in a non-printing region which becomes a right side with respect to the third roller 23, a maintenance mechanism 28 for performing maintenance of the recording head 27 at the time of non-printing is installed.

The drying device 16A is arranged to be overlapped with the platen 19 in the up and down direction, and is configured to be partly overlapped with the platen 19 when seen from a planar view. Further, the recording medium 13 in which the printing is performed in the printing room 15 is rolled up on an upper right side of the third roller 23, the transport direction thereof is changed in the vertical down direction to be transported toward the drying device 16A which is located under the base 18. That is, the third roller 23 functions as a first transport direction changing means which changes the transport direction of the recording medium 13 by bending the transport path of the recording medium 13, in a downstream position of the transport path of the recording medium 13 with respect to the platen 19. Further, before the recording medium 13 is introduced into the drying device 16A, the third roller 23 comes in contact with a rear surface side of the recording medium 13 opposite to a printing surface (one surface) thereof in which the printing is performed in the printing room 15, and thus, the third roller 23 functions as a medium guide which changes the transport direction of the recording medium 13 so that the printing surface of the recording medium 13 may not become a concave surface.

Further, the recording medium 13 passes through the drying device 16A while the transport direction thereof is being guided by a guide member 30, and thus, a drying process is performed with respect to the printing surface in which the printing is performed in the printing room 15. A reference numeral L2 in FIG. 3 represents the length of a drying region in the transport direction of the recording medium in the drying device 16A (which is the case with the another embodiment illustrated in FIG. 5), which is set to be equal to or larger than the above described recording region size L1 in the present embodiment. Further, the recording medium 13 which is discharged from the drying device 16A in the vertical up direction is rolled up on a fourth roller 31, and thus, the transport direction thereof is changed into the vertical down direction. That is, the fourth roller 31 functions as a second transport direction changing means which changes the transport direction of the recording medium 13 by bending the transport path of the recording medium 13, in a downstream position of the transport path of the recording medium 13 with respect to the drying device 16A. Further, after the recording medium 13 is discharged from the drying device 16A, the fourth roller 31 comes in contact with the printing surface of the recording medium 13 in which the printing is performed in the printing room 15, and thus, the fourth roller 31 functions as a medium guide which changes the transport direction of the recording medium 13 so that the printing surface of the recording medium 13 becomes a concave surface.

Further, the rotation diameter of the fourth roller 31 is configured to be larger than the rotation diameter of the third roller 23. The curvature of a curved section 31*a* of the transport path of the recording medium 13 formed by the fourth roller 31 is set to be smaller than the curvature of a curved section 23*a* of the transport path of the recording medium 13 formed by the third roller 23.

Further, the recording medium 13 of which the transport direction is changed into the vertical down direction by the fourth roller 31 is rolled up from an upper left side of a fifth roller 32. After the transport direction of the recording medium 13 is changed into the horizontal right direction by the fifth roller 32, the recording medium 13 is transported toward the rolling section 17 which is located on the right side of the fifth roller 32.

In the rolling section 17, a rolling shaft 33 which is a transport means which extends in the front and rear direction in the state of being in parallel with the fifth roller 32 is installed, and a leading edge which becomes a downstream edge of the transport direction of the recording medium 13 is rolled on the rolling shaft 33. Further, the rolling shaft 33 is driven to rotate on the basis of driving power of a transport motor (not shown), and thus, the recording medium 13 is sequentially rolled to the rolling shaft 33.

Next, a configuration of the drying device 16A will be described.

As shown in FIG. 2, the drying device 16A includes a casing 34 in the shape of a box having an empty inside. An air supply opening 35 is formed in a lower part of a left side wall section of the casing 34, and a warm air blowing mechanism 37 is connected to the air supply opening 35 through an air supply duct 36. Further, the warm air blowing mechanism 37 is configured to heat an internal space 38 of the casing 34 by the warm air supplied inside the casing 34 through the air supply duct 36.

Further, an air discharge opening 39 is formed in approximately a central part of a top wall section of the casing 34, and an air discharge fan 41 is connected to the air discharge opening 39 through an air discharge duct 40. Further, air heated by the warm air in the internal space 38 of the casing 34 is discharged outside the casing 34 through the air discharge duct 40, in accordance with driving of the air discharge fan 41. That is, the flow of the heated air is generated in the internal space 38 of the casing 34.

Further, in the top wall section of the casing 34, a pair of left and right through openings 42 and 43 is formed to be separated from each other with the air discharge opening 39 being interposed therebetween. Further, the through openings 42 and 43 are formed so that the width sizes of the through openings 42 and 43 in the front and rear direction become larger than the width size of the recording medium 13 in the front and rear direction, to thereby allow the recording medium 13 to pass therethrough.

Further, in the casing 34, the guide member 30 having an approximate U shape when seen from a front view is installed to be connected with the top wall section of the casing 34 so that a pair of left and right upper end sections of the guide member 30 is aligned with the through openings 42 and 43, respectively. Further, in the casing 34, a plurality (12 items in this embodiment) of axial fans 44 is arranged so that the axial fans 44 are laterally disposed along a surface of the guide member 30 which forms the transport path of the recording medium 13 in the casing 34, and so that each blowing direction thereof becomes approximately vertical with respect to the printing surface of the recording medium 13 moving along the surface of the guide member 30. Further, the axial fans 44 are configured to blow the air inside the casing 34 heated by the warm air blowing mechanism 37 as the warm air toward the printing surface of the recording medium 13, to thereby facilitate the drying of the printing surface of the recording medium 13 in the internal space 38 of the casing 34.

Next, an operation of a printer 11A with such a configuration, and in particular, an operation at the time when the printing surface of the recording medium 13 is heated and fixed in the process of passing through the drying device 16A will be described hereinafter.

Right after starting the operation of the printer 11A, firstly, the drying device 16A operates the warm air blowing mechanism 37, to thereby blow the warm air into the internal space 38 of the casing 34 from the warm air blowing mechanism 37. Then, the air contained in the internal space 38 of the casing 34 is heated and is gradually increased in temperature. At this time, as the air in the internal space 38 of the casing 34 is heated, the guide member 30 is heated until the temperature thereof becomes nearly the same temperature as in the internal space 38 of the casing 34 by the heated air.

Subsequently, at a point of time when the temperature of the guide member 30 is stabilized, the transport motor is driven to rotate the rolling shaft 33. Then, in accordance with the rotation driving of the rolling shaft 33, the leading edge which becomes the downstream edge of the recording medium 13 in the transport direction is sequentially rolled on the rolling shaft 33. Further, the recording medium 13 in which the printing is performed in the printing room 15 is transported toward the drying device 16A in the state where the transport direction is changed into the vertical down direction by the third roller 23.

In this respect, the recording medium 13 in which the printing is performed in the printing room 15 is heated through the upper surface 19*a* of the platen 19 heated by the platen heater 19*b*. Then, moisture contained in ink adhered to the recording medium 13 is evaporated to thereby increase the viscosity of the ink. Thus, even though the transport direction of the recording medium 13 is changed into the vertical down direction toward the drying device 16A from the upper surface 19*a* of the platen 19, the ink adhered to the recording medium 13 does not flow down due to gravity, and a printed image formed on the recording medium 13 is prevented from being jumbled.

Further, the transport path of the recording medium 13 does not bend in such a manner that the printing surface of the recording medium 13 forms a concave surface shape by the third roller 23 which is installed between the platen 19 and the drying device 16A. Accordingly, since the printed image formed on the recording medium 13 does not come in contact with the third roller 23 in a stage before the printed image is heated in the internal space 38 of the casing 34 and is sufficiently fixed in the recording medium 13, the printed image formed on the recording medium 13 is prevented from being jumbled.

Further, the recording medium 13 transported to the drying device 16A enters into the internal space 38 of the casing 34 through the right through opening 42 among one pair of through openings 42 and 43 of the drying device 16A which is formed in the top wall section of the casing 34, in a state where the printing surface to which the ink is ejected is directed to the right side. Subsequently, the recording medium 13 entered into the internal space 38 of the casing 34 passes through the internal space 38 of the casing 34 in a state where the rear surface opposite to the printing surface to which ink is ejected is in contact with the surface of the guide member 30. Accordingly, the recording medium 13 is heated from the rear surface opposite to the printing surface through the surface of the guide member 30 having nearly the same temperature as in the internal space 38 of the casing 34.

Further, on the printing surface of the recording medium 13, the air heated in the internal space 38 of the casing 34 from the axial fans 44 is blown in an approximately vertical direction. Then, the printing surface of the recording medium 13 is heated by the warm air blown from the axial fans 44, and an ink vapor layer and an ink solvent vapor layer floating on the printing surface of the recording medium 13 are appropriately removed from the printing surface of the recording medium 13.

In the stage before the printed image is heated in the internal space 38 of the casing 34 and is sufficiently fixed in the recording medium 13, the printing surface of the recording medium 13 does not come in contact with the third roller 23, and only the rear surface of the recording medium 13 opposite to the printing surface comes in contact with the third roller 23. Accordingly, the recording medium 13 comes to have an unstable support state with respect to the third roller 23, compared with a case where the printing surface of the recording medium 13 and the rear surface opposite to the printing surface are all pinched by the pair of rollers. Accordingly, if the warm air is blown from the axial fans 44 in the internal space 38 of the casing 34, the recording medium 13 may remarkably flip-flop in a state where the printed image formed on the printing surface of the recording medium 13 is not sufficiently fixed to the recording medium 13, thereby causing the printed image formed on the recording medium 13 to be jumbled.

In this respect, according to the present embodiment, the recording medium 13 is supported from the rear surface opposite to the printing surface by the guide member 30 in the internal space 38 of the casing 34. Thus, even though the warm air is blown from the axial fans 44 to the recording medium 13, the printed image of the recording medium 13 hardly goes astray and the printed image formed on the recording medium 13 is prevented from being jumbled.

Further, the air blown to the printing surface of the recording medium 13 from the axial fans 44 enters a space region of a rear surface side opposite to a contact surface of the guide member 30 with respect to the recording medium 13. Further, the air is rapidly discharged from the internal space 38 of the casing 34 through the air discharge duct 40 in the state of including lots of ink and ink solvents removed from the printing surface of the recording medium 13. Accordingly, even in the case where the drying device 16A is operated for a long time, the ink and ink solvents volatilized from the printing surface of the recording medium 13 hardly remain in the internal space 38 of the casing 34.

Thereafter, the recording medium 13 is transported outside the casing 34 according to the through opening 43 located on the left side among the pair of through openings 42 and 43 installed in the top wall section of the casing 34 of the drying device 16A. In this respect, the transport direction of the recording medium 13 is smoothly changed by the fourth roller 31, right after the fixing process is performed in the internal space 38 of the casing 34. Accordingly, even though the recording medium 13 is in a state where an adhesive which bonds the seal material 13*a* to the base film 13*b* is heated in the internal space 38 of the casing 34 to be in a semi-molten state, and thus, an adhesive force thereof becomes weak, the seal material 13*a* is prevented from being separated from the base film 13*b*. Further, in a state where the printing surface of the recording medium 13 is fixed in the process of passing through the internal space 38 of the casing 34, after the transport direction of the recording medium 13 is sequentially changed by the fourth roller 31 and the fifth roller 32, the recording medium 13 is rolled on the rolling shaft 33.

According to the present embodiment, the following effects can be achieved.

(1) In the above described embodiment, the platen 19 and the drying device 16A are arranged to be partly overlapped with each other from a planar view. Thus, these elements partly share an installation space in the horizontal direction (left and right direction), whereby the installation space for these elements can be reduced in size. As a result, the entire apparatus can be restricted from being large-sized in the horizontal direction.

(2) In the above described embodiment, at a point of time before the ink adhered to the recording medium 13 is dried by the drying device 16A, the transport direction of the recording medium 13 is changed in a state where the platen 19 does not contact the surface to which the ink is adhered. Thus, the platen 19 and the drying device 16A are arranged to be overlapped with each other in the up and down direction, and thus, even in the case where the transport direction of the recording medium 13 is changed toward the drying device 16A, a printing image formed on the recording medium 13 can be restricted from being jumbled on the platen 19.

(3) In the above described embodiment, in the region of the recording medium 13 to which the ink is adhered, the air heated by the warm air blowing mechanism 37 is blown from the axial fans 44 in the internal space 38 of the casing 34 which is the fixing region of the drying device 16A, and the ink adhered to the recording medium 13 can be reliably dried and fixed. Further, since the air is blown from the axial fans 44 in the state where the recording medium 13 is supported by the guide member 30 in the internal space 38 of the casing 34 of the drying device 16A, the recording medium 13 hardly goes astray as the air is blown from the axial fans 44 in the internal space 38 of the casing 34 of the drying device 16A, and thus, the printing image formed on the recording medium 13 can be restricted from being jumbled.

(4) In the above described embodiment, the ink adhered to the recording medium 13 is heated through the upper surface of the platen 19 and is partly solidified to have an increased viscosity, in the process of passing through over the platen 19. Thus, even in a case where the transport direction of the recording medium 13 is changed in a downstream position of the transport path with reference to the platen 19, the ink adhered to the recording medium 13 hardly flows down due to the gravity, and thus, the printing image formed on the recording medium 13 can be restricted from being jumbled.

(5) In the above described embodiment, even though an adhesive force of an adhesive which bonds the seal material 13*a* and the base film 13*b* becomes weak when the recording medium 13 is heated in the process of passing through the fixing region of the drying device 16A, since the transport direction of the recording medium 13 is smoothly changed by means of the fourth roller 31 on the downstream side of the transport path with reference to the fixing region of the drying device 16A, the seal material 13*a* and the base film 13*b* can be restricted from being separated from each other.

(6) In the above described embodiment, the length L2 of the drying region in the transport direction of the recording medium in the drying device 16A is equal to or larger than the length L1 of the recording region in the transport direction of the recording medium on the platen 19 (L2≥L1). Thus, the recording surface after completion of recording necessarily stays in the drying device 16A at least one time for the recording medium stop time in the intermittent transport. Accordingly, it is possible to prevent part of the recording surface after completion of recording from simply passing through the drying device 16A without stopping in the drying device 16A, to secure the time for which the entire recording surface after completion of recording stays in the drying device 16A, and to thereby sufficiently dry the recording surface.

(7) In the above described embodiment, since the bending transport path 70 (from the fifth roller 32 to the rolling section 17) which is bent after being discharged from the drying device 16A and then is directed to the rolling section 17 is arranged to be overlapped with the drying device 16A under the drying device 16A, the entire recording apparatus can be restricted from being large-sized in the horizontal direction.

(8) In the above described embodiment, if it is assumed that the upper transport path 50 including the platen 19 (from the second roller 22 to the third roller 23) is referred to as an upper stage and the intermediate transport path 60 including the drying device 16A under the upper transport path 50 is referred to as an intermediate stage, the fourth roller 31 which is installed in the intermediate stage and serves as the transport roller for transporting the recording medium is provided on the outside of the drying device 16A. Thus, the temperature irregularities inside the drying device 16A can be prevented, and the heat can be prevented from being escaped through the roller, and thus, the decrease in the fixing efficiency in the drying device 16A can be prevented.

Hereinafter, modified embodiments of the above described embodiment will be described. In this respect, the same components of the modified embodiments are given the same reference numerals as in the first embodiment, and description thereof will be omitted.

Figure 4A:
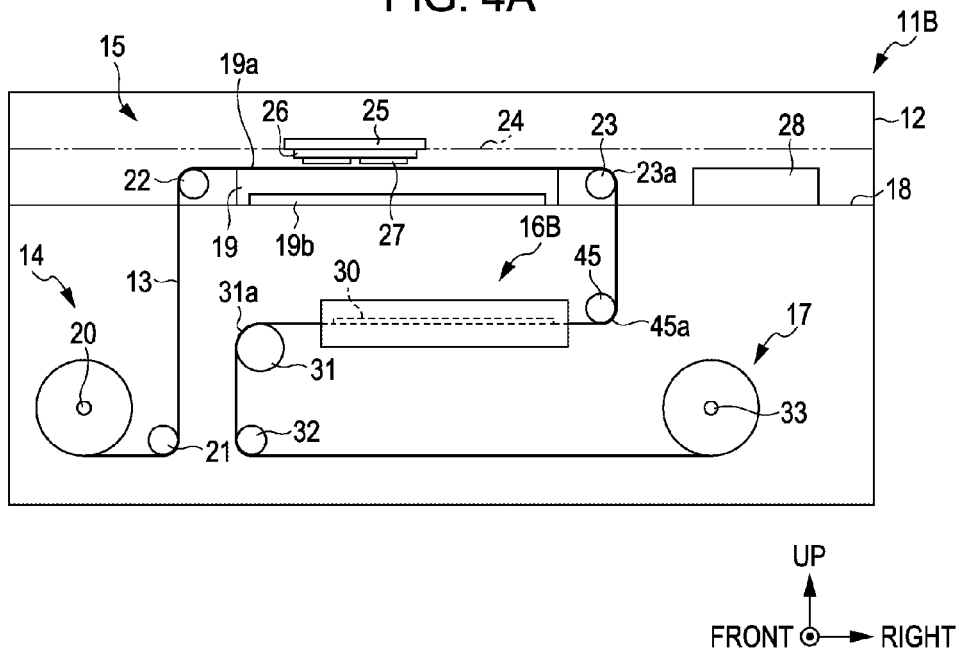
FIG. 4A is a diagram illustrating a schematic configuration of a recording apparatus according to a second embodiment of the present invention.
Figure 4B:
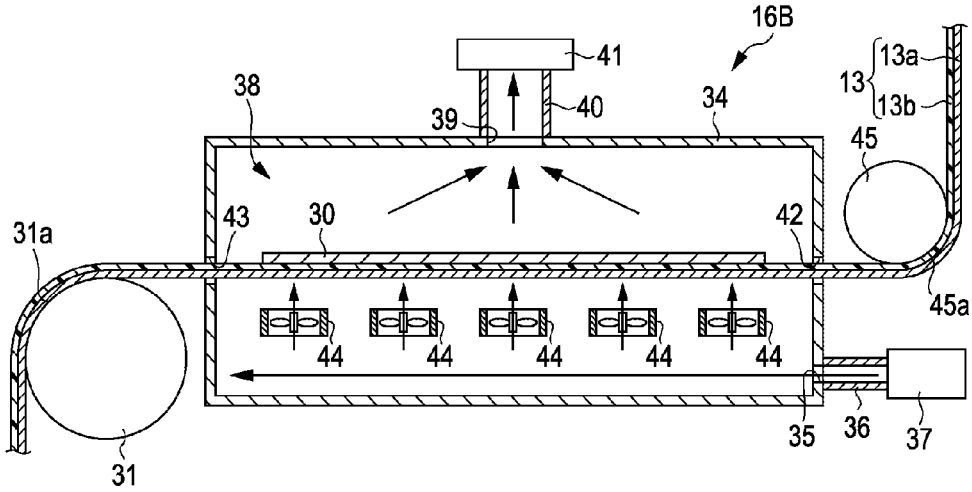
FIG. 4B is a sectional view illustrating a drying device in the same recording apparatus.

As shown in FIGS. 4A and 4B, in a printer 11B according to a second embodiment of the present invention, a drying device 16B may be configured so that the guide member 30 is horizontally extended along the upper surface 19*a* of the platen 19 in the internal space 38 of the casing 34. In such a configuration, since the drying device 16B and the platen 19 are arranged to be overlapped with each other in the up and down direction, the installation space of the drying device 16B does not need to be independently installed in the horizontal direction with respect to the installation space of the platen 19. Accordingly, the installation space of the drying device 16B can become small in size, and thus, the printer 11B can be restricted from being large-sized in the horizontal direction. Further, in such a configuration, in a case where a changing roller 45 for changing the transport direction of the recording medium 13 approximately in the horizontal direction is installed between the third roller 23 and the drying device 16B in the transport path of the recording medium 13, it is preferable that the changing roller 45 comes in contact with an opposite surface to the recording surface in the recording medium 13 so as not to bend the recording surface of the recording medium 13 in a concave shape.

In addition, in the present embodiment, since the upper transport path 50 (from the second roller 22 to the third roller 23), the intermediate transport path 60 including the drying device 16B (from the changing roller 45 to the fourth roller 31) and the bending transport path 70 (from the fifth roller 32 to the rolling section 17) are arranged to be overlapped with each other in a parallel manner, the height of the apparatus can be restricted to the minimum size.

In the present embodiment, the length L2 of the drying region in the transport direction of the recording medium in the drying device 16B is equal to or larger than the length L1 of the recording region in the transport direction of the recording medium on the platen 19. Thus, the recording surface after completion of recording necessarily stays in the drying device 16B at least one time for the recording medium stop time in the intermittent transport. Accordingly, it is possible to prevent part of the recording surface after completion of recording from simply passing through the drying device 16B without stopping in the drying device 16B so as to secure the time for which the entire recording surface after completion of recording stays in the drying device 16B, and to sufficiently dry the recording surface.

Further, in the intermediate path (intermediate stage) 60, since the changing roller 45 as the transport roller for transporting the recording medium and the fourth roller 31 is installed on the outside of the drying device 16B, apart from the inside of the drying device 16B, the fixing efficiency in the drying device 16B can be prevented from being decreased.

In the present embodiment, the rolled lengths of the recording medium 13 with respect to the outer circumferential surfaces of the fourth roller 31 and the fifth roller 32 are respectively set to ¼ of the lengths of the circumferential surfaces of the respective rollers. That is, since the recording medium 13 is made of the seal material 13*a* and the base film 13*b* which are adhered to each other and the adhesive force of the adhesive which bonds the seal material 13*a* and the base film 13*b* becomes weak in the process in which the recording medium 13 passes through the fixing region of the drying device 16B, if the rolled lengths with respect to the outer circumferential surfaces of the rollers become long, (that is, if rolled angles become large), the separation may occur. However, as the rolled lengths are restricted to be short, the seal material 13*a* and the base film 13*b* can be restricted from being separated from each other.

Figure 6A:
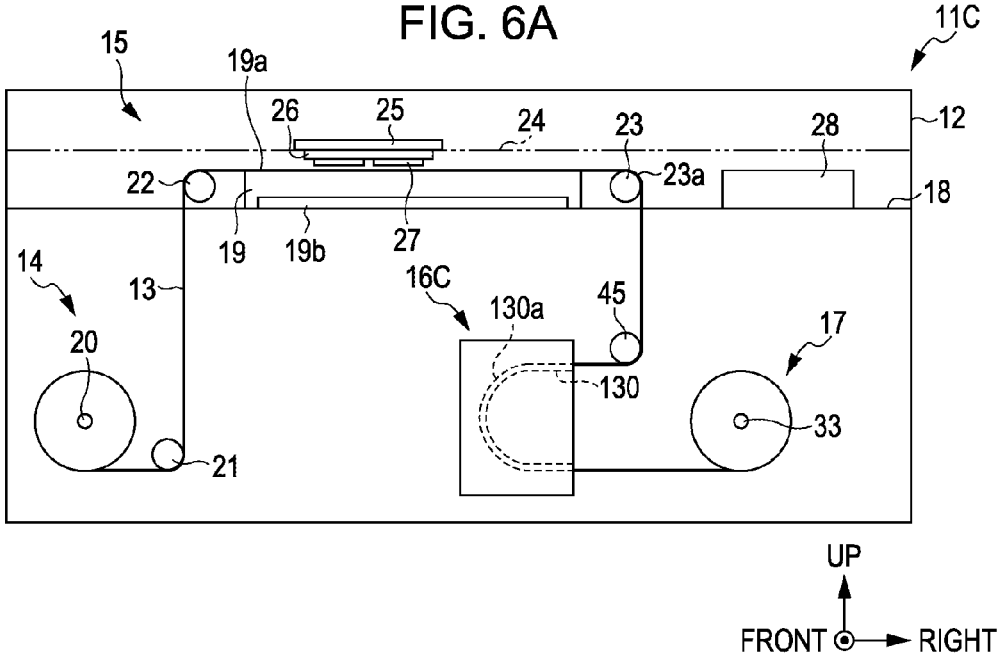
FIG. 6A is a diagram illustrating a schematic configuration of a recording apparatus according to a third embodiment of the present invention.
Figure 6B:
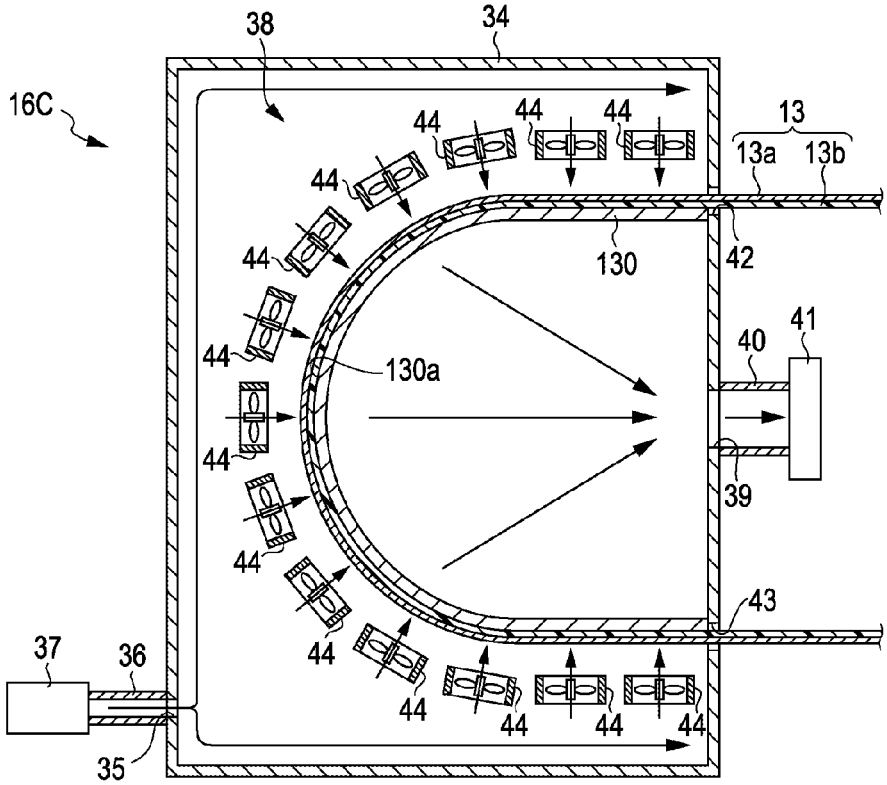
FIG. 6B is a sectional view illustrating a drying device in the same recording apparatus.

As shown in FIGS. 6A and 6B, according to a third embodiment of the present invention, a drying device 16C may be configured so that a guide member 130 is curved in an approximate U shape in the internal space 38 of the casing 34. According to such a configuration, the guide member 130 has the function of supporting an opposite surface to the recording surface in the recording medium 13 in the internal space 38 of the casing 34 and the function of curving the transport path of the recording medium 13 to change the transport direction of the recording medium 13. Thus, the number of parts constituting the drying device 16C can be reduced, to thereby contribute to the miniaturization of the printer 11. Further, in this configuration, the drying device 16C is preferably configured so that the curvature of a curved section 130*a* which is formed in the transport path of the recording medium 13 by means of the guide member 130 which is a second transport direction changing means is smaller than the curvatures of a curved section 23*a* and a curved section 45*a* which are formed in the transport path of the recording medium 13 by means of the third roller 23 which is a first transport direction changing means and the changing roller 45.

In the present embodiment, the length (not shown) of the drying region in the transport direction of the recording medium in the drying device 16C is equal to or larger than the length (not shown) of the recording region in the transport direction of the recording medium on the platen 19. Thus, it is possible to secure the time for which the recording surface after completion of recording stays in the drying device 16C, and to sufficiently dry the recording surface. Further, since the transport roller is not installed inside the drying device 16C, it is possible to prevent the fixing efficiency in the drying device 16C from being decreased.

Figure 7A:
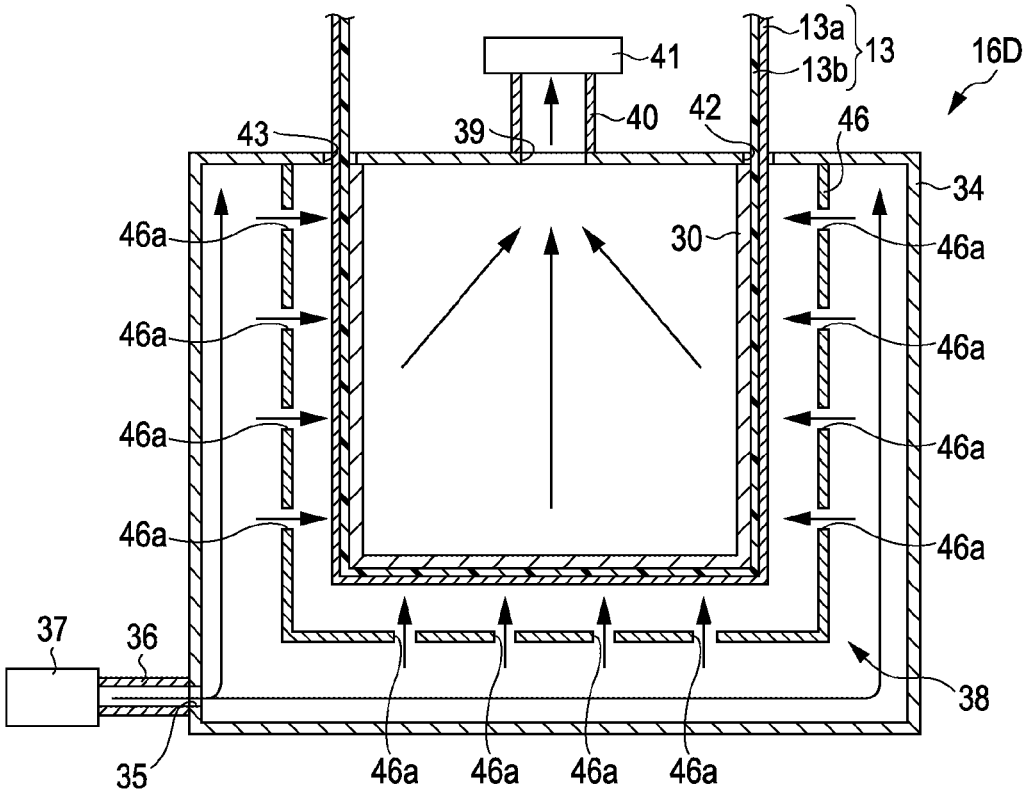
FIG. 7A is a sectional view illustrating a drying device according to a fourth embodiment of the present invention.
Figure 7B:
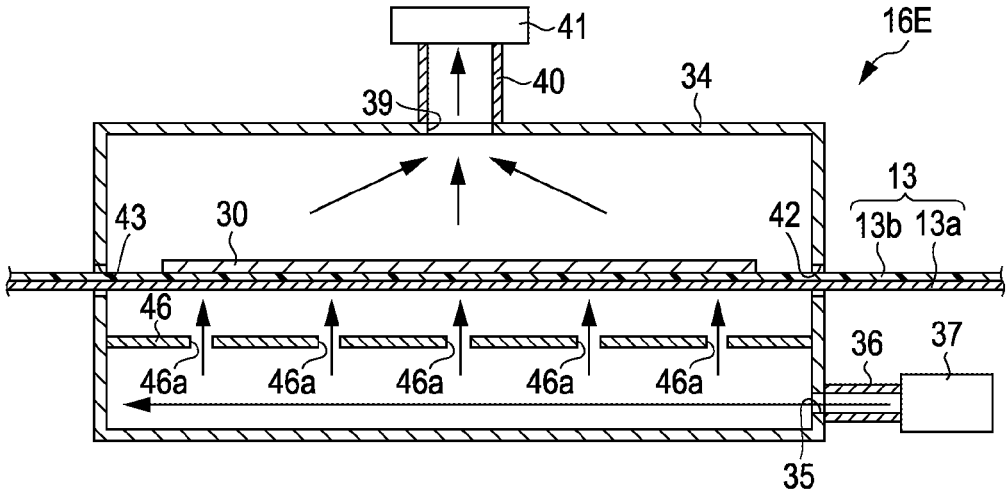
FIG. 7B is a sectional view illustrating a drying device according to a fifth embodiment of the present invention.

According to a fourth and a fifth embodiments, as shown in FIGS. 7A and 7B, a drying device 16D and a drying device 16E each may be configured so that a slit plate 46 is installed so as to face a contact surface of the guide member 30 with respect to the recording medium 13. According to such a configuration, since an air flow acts on the recording surface of the recording medium 13 in an approximately perpendicular direction through slit holes 46*a* formed in the slit plate 46, the drying of the recording surface of the recording medium 13 can be facilitated.

In the present embodiment, since the length (not shown) of the drying region in the transport direction of the recording medium in the drying device 16D is equal to or larger than the length (not shown) of the recording region in the transport direction of the recording medium on the platen 19, it is possible to secure the time for which the recording surface after completion of recording stays in the drying device 16D, and to sufficiently dry the recording surface. Further, since the transport roller is not installed inside the drying device 16D, it is possible to prevent the fixing efficiency in the drying device 16D from being decreased.

In the above described embodiments, the drying devices 16A to 16C each may be configured so that a radiant heater is installed so as to face the printing surface of the recording medium 13 in the internal space 38 of the casing 34. In this case, the recording medium hardly goes astray due to radiation heat radiated from the radiant heater in the internal space 38 of the casing 34, and thus, the drying device 16 may employ such a configuration that a support section for supporting the recording medium 13 is not provided.

In the above described embodiments, the curvature of the curved section 31*a* which is formed by the fourth roller 31 in the transport path of the recording medium 13 may be larger than the curvature of the curved section 23*a* which is formed by the third roller 23 in the transport path of the recording medium 13. That is, so as to prevent the seal material 13*a* and the base film 13*b* from being separated from each other right after the recording medium 13 undergoes the fixing process in the drying device 16, the fourth roller 31 may employ any arbitrary configuration in which the transport direction of the recording medium 13 is changed in a sufficiently smooth manner.

In the above described embodiments, the platen heater 19*b* for heating the upper surface 19*a* of the platen 19 may not be provided. In this case, it is preferable that ink having a sufficient viscosity is employed as the ink ejected onto the printing surface of the recording medium 13 in the printing room 15, so as to prevent the ink from flowing down due to gravity when the transport direction of the recording medium 13 is changed in the vertical down direction.

In the above described embodiments, the drying devices 16A to 16C each may be configured so that a heater for heating the internal space 38 of the casing 34 is installed and the warm air blown toward the recording medium 13 from the axial fans 44 is circulated in the internal space 38 of the casing 34. In this case, it is preferable that an adsorbing filter for adsorbing and collecting the ink and ink solvent which is volatilized from the printing surface of the recording medium 13 is installed in a midstream position of a flow path of the air flow which is circulated in the internal space 38 of the casing 34.

In the above described embodiments, ink having a UV (ultraviolet) curing property may be used as the ink which is ejected toward the printing surface of the recording medium 13 from the recording head 27. In this case, a UV illumination device having a UV light source which is arranged to face the printing surface of the recording medium 13 in the transport path of the recording medium 13 may be employed as the fixing unit for fixing the ink adhered to the recording medium 13.

In the above described embodiments, a combination of arbitrary members may be employed as the plurality of members forming the recording medium 13. Alternatively, the recording medium 13 may be formed of a single member.

In the above described embodiments, the recording medium 13 may be continuously transported according to the rotation driving of the rolling shaft 33.

In the above described embodiments, the recording apparatus is embodied as the ink jet printer, but is not limited thereto. The recording apparatus may be applied to a liquid ejection apparatus which ejects or discharges a liquid other than ink (including a liquid material in which particles of a functional material are dispersed or mixed in a liquid, or a fluid material such as gel). For example, the recording apparatus may be embodied as a liquid ejection apparatus which ejects a liquid (liquid material) including materials such as electrode materials or color materials (pixel materials) used for manufacturing liquid crystal displays, EL (electroluminescent) displays, surface emitting displays and so on, in a dispersed or solved form, as a liquid ejection apparatus which ejects bioorganic materials used for manufacturing biochips, and as a liquid ejection apparatus which is used as a precise pipette and is configured to eject liquids as specimens. Further, the recording apparatus may be applied to a liquid ejection apparatus which ejects lubricants with pinpoints to precision machines such as clocks or cameras, a liquid ejection apparatus which ejects onto a substrate a transparent resin liquid such as ultraviolet cured resin used for forming a micro hemispherical lens (optical lens) or the like which is used in an optical communication element or the like, a liquid ejection apparatus which ejects an etching liquid such as acids or alkalis for etching a substrate or the like, and a liquid ejection apparatus which ejects a liquid (fluid material) such as gel (for example, physical gel). That is, the present invention may be applied to any one type of liquid ejection apparatus, among these liquid ejection apparatuses.

What is claimed is:

1. A recording apparatus comprising:

a support member which supports a recording medium;

a recording head which applies a recording material to one surface of the recording medium supported on the support member, wherein the support member includes a platen that is heated and configured to increase a viscosity of ink adhered to the one surface of the recording medium, the platen having a first end and a second end, the recording medium passing from the first end to the second end in a transport direction for the recording head to apply the recording material; and a fixing unit which fixes the recording material adhered to the one surface of the recording medium transported from the support member, the fixing unit including a guide member, wherein a surface of the recording medium is supported by the guide member while inside the fixing unit, wherein the support member and the fixing unit are arranged to be partly overlapped with each other in an up and down direction, wherein a length of a drying region and of the guide member in the transport direction of the recording medium in the fixing unit being configured to be equal or larger than a length of a recording region on the support member, and wherein the recording medium enters the fixing unit at a location beyond the second end of the platen in the transport direction and exits the fixing unit at another location between the first end and the second end of the platen and beneath the platen in an up and down direction.

2. The recording apparatus according to claim 1, wherein the recording head moves in a transport direction of the recording medium in a state where the recording medium is positioned on the support member to perform recording, and wherein the length of a fixing region of the fixing unit in the transport direction of the recording medium is equal to or larger than the length of a recording region of the support member in the transport direction of the recording medium.

3. The recording apparatus according to claim 2, wherein the support member is in an upper stage, wherein a transport roller which transports the recording medium is installed in an intermediate stage with the fixing unit, wherein the transport roller is provided on the outside of the fixing unit, not on the inside of the fixing unit.

4. The recording apparatus according to claim 3, further comprising a rolling unit which rolls the recording medium after completion of recording, wherein a bending transport path of the recording medium, in which the recording medium is bent after being discharged from the fixing unit and is directed to the rolling unit, is arranged to be partly overlapped with the fixing unit under the fixing unit.

5. The recording apparatus according to claim 4, wherein an intermediate transport path including the fixing unit is installed under an upper transport path including the support member, and wherein the upper transport path, the intermediate transport path and the bending transport path are arranged to be partly overlapped with each other in a parallel manner.

* * * * *